US006523287B1

(12) United States Patent
Lee

(10) Patent No.: US 6,523,287 B1
(45) Date of Patent: Feb. 25, 2003

(54) DECORATIVE AQUA BALL

(76) Inventor: Sern-Chen Lee, 6F-2, No. 194,Ming-Sheng Rd., Hsinchu (TW)

( * ) Notice: Subject to any disclaimer, the term of this patent is extended or adjusted under 35 U.S.C. 154(b) by 0 days.

(21) Appl. No.: 10/033,648

(22) Filed: Dec. 27, 2001

(51) Int. Cl.[7] ..... G09F 19/00
(52) U.S. Cl. ..... 40/410; 40/406; 446/267
(58) Field of Search ..... 40/410, 409, 407, 40/406, 411; 84/94.2, 95.2; 446/267

(56) References Cited

U.S. PATENT DOCUMENTS 4,757,986 A * 7/1988 Hwang et al. ..... 472/6
5,314,365 A * 5/1994 Chen ..... 446/133
5,743,780 A * 4/1998 Liu ..... 446/136
5,864,976 A * 2/1999 Yang ..... 40/410
5,875,577 A * 3/1999 Lu ..... 40/411
6,078,000 A * 6/2000 Chen ..... 84/107
6,132,284 A * 10/2000 Lin ..... 446/267
6,161,317 A * 12/2000 Wang ..... 40/406
6,167,647 B1 * 1/2001 Yang ..... 40/430
6,357,151 B1 * 3/2002 Yuen ..... 40/406

FOREIGN PATENT DOCUMENTS

TW 2322311 Y 6/1999

* cited by examiner

*Primary Examiner*—W Miller

(57) ABSTRACT

A decorative aqua ball mainly comprises a base, a power device disposed in a cavity of the base, a music box connected with the power device, a transparent casing sitting on the base, an ornamental article placed in the transparent casing, and a lid plug hermetically sealed on an opening of the casing. The aqua ball further comprises a rotation device which is composed of an upper turntable and a lower turntable situated on the lid plug on respective top and bottom faces in virtue of mutual attraction of respective pieces of enhanced magnets residing face to face on the turntables. By proper arrangement of the magnets, both turntables can rotate synchronously without needing extra power so that a reliable aqua ball is realized to present dynamic sightly scene for appreciation.

13 Claims, 6 Drawing Sheets

DECORATIVE AQUA BALL

FIELD OF THE INVENTION

This invention relates to the improvement of a home-living decorative article, particularly to a decorative aqua ball.

BACKGROUND OF THE INVENTION

An existing decorative aqua ball usually is composed of a base, a music box, a transparent casing, an inside ornamental article, a lid plug, etc. The base is provided with the music box and a power device for driving the former to play a piece of predetermined music. The lid plug is covered on an opening of the transparent casing, which is fully filled with water and brilliant colorful drift, to thereby set the ornamental article in place on the lid plug in the casing. Such a decorative aqua ball would function to sound with an actuator, either an electric machine or a spring. One drawback of the conventional decorative aqua ball is that a user has to turn it upside down to create floating effect of the drift.

For improvements, some makers have installed a motor in the transparent casing for driving the drift instead. However, irrespective of its waterproof structure, the motor which is submerged longtime in water will gradually lose its waterproof-ness in the long run. Meanwhile, the anti-corrosive butter or machine oil applied onto the shaft of a rotor may leak to contaminate the casing to spoil the beauty of the decorative aqua ball.

Again, for improvements of the above mentioned motor, a China patent numbered CN2322311Y has disclosed another waterproof motor device for driving and cycling water flow in the aqua ball in which the driving means is installed in a protective sleeve in a through hole of a lid plug, and then a rotation member and a rowing member are arranged on the protective sleeve. Nevertheless, such a structure inevitably still results in water leakage of the aqua ball sooner or later because of the through hole of the lid plug and the operation of electromechanical parts stops. The decorative article becomes meaningless as the inside ornamental article is standing still in the aqua ball.

SUMMARY OF THE INVENTION

The primary object of this invention is to provide a decorative aqua ball mainly comprising a base, a power device, a music box, a transparent casing, and a lid plug.

The aqua ball further comprises a rotation means which is composed of upper and lower turntables situated on the lid plug on respective top and bottom faces in virtue of mutual attraction of respective pieces of enhanced magnets residing face to face on the turntables.

An additional water-rowing device provided to the decorative aqua ball consists of an oar-blade set, a positioning shaft, and a transmission gear set having internal teeth. The positioning shaft is fixed centrally on a steady table with its top end extended over the top surface of the upper turntable. The oar-blade set is situated above the top surface of the upper turntable and is jointed with an upper segment of a rear stage gear of the transmission gear set and fixed to the positioning shaft through a snap ring, while the lower segment of the rear stage gear of the transmission gear set is sleeve-jointed with the positioning shaft. Both a front stage gear and a middle stage gear are installed on the bottom surface of the upper turntable, in which the front stage gear is engaged with the internal teeth of the ferrule, which is fixed at a middle portion of the steady table.

A plurality of enhanced pieces of magnets is distributed on both faces of the lid plug to form a robust and low cost structure to realize a synchronous rotation of the upper turntable and the lower turntable without needing extra power. This invention requires no opening in the lid that can render a hermetic seal to avoid any leakage of water. When the aqua ball rotates, the water flow in the transparent casing is driven to recycle repetitively by taking advantage of a water-rowing device, a transmission gear set, and an oar-blade set to thereby show a pleasant scene of drilling phenomenon.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
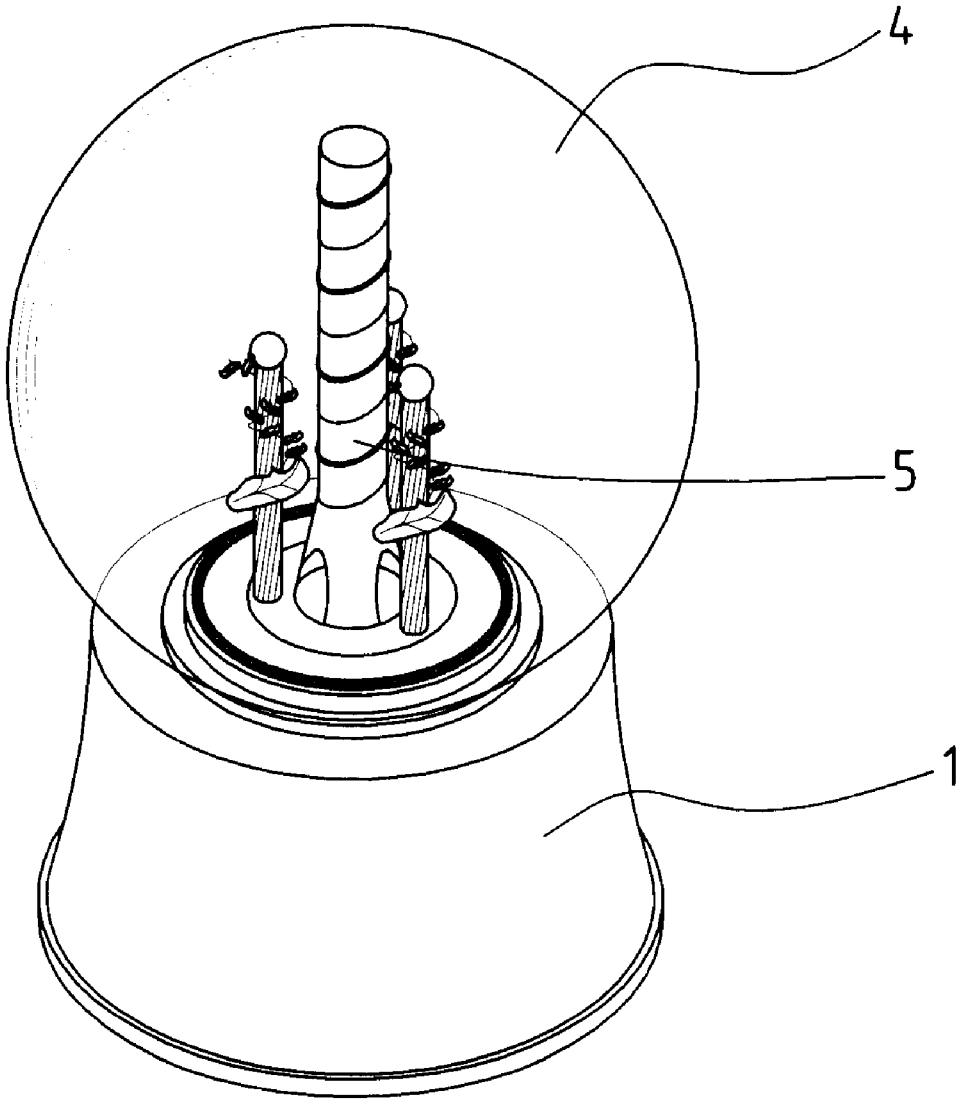
FIG. 1 is a schematic structure view of this invention.
Figure 2:
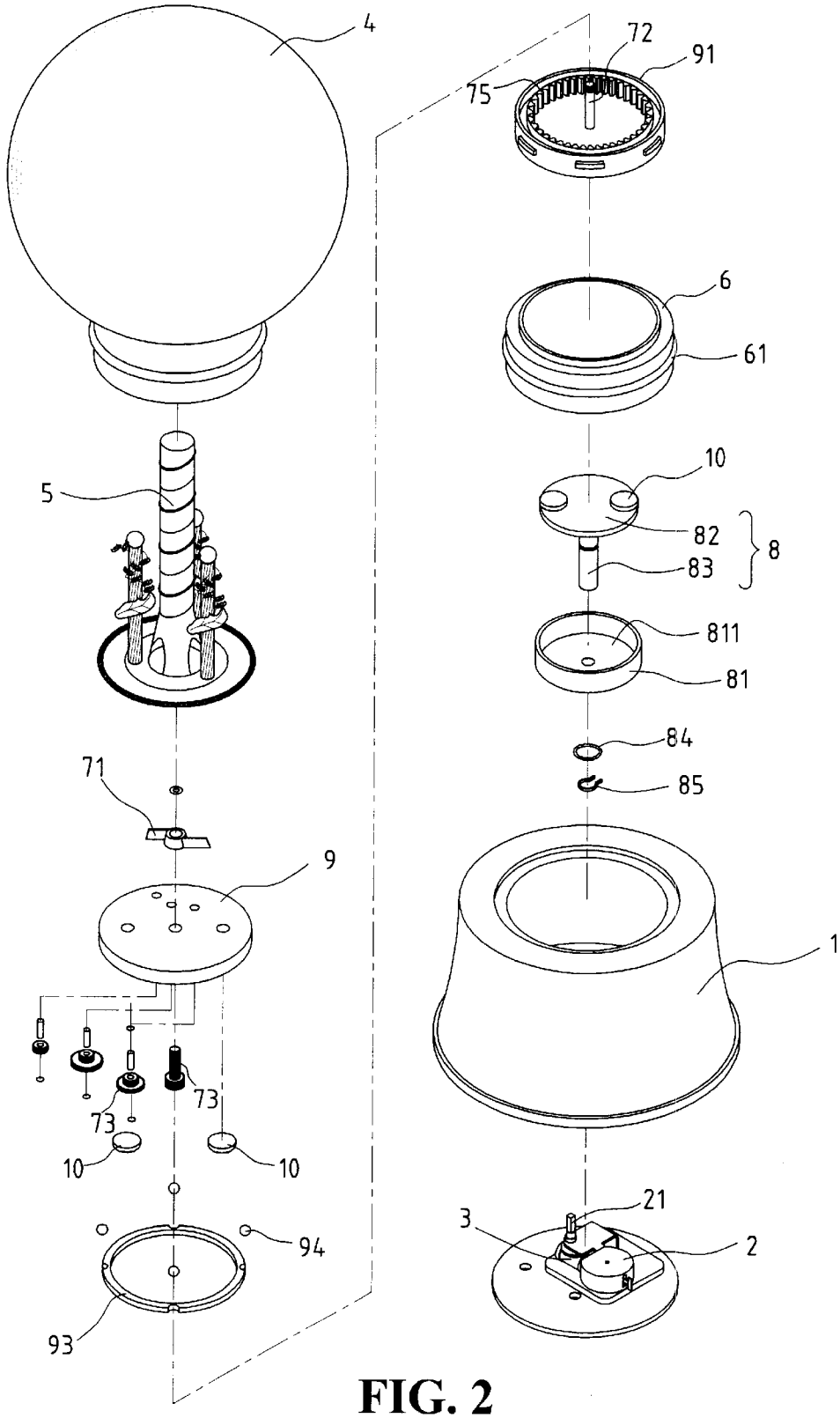
FIG. 2 is an exploded view of this invention.
Figure 3:
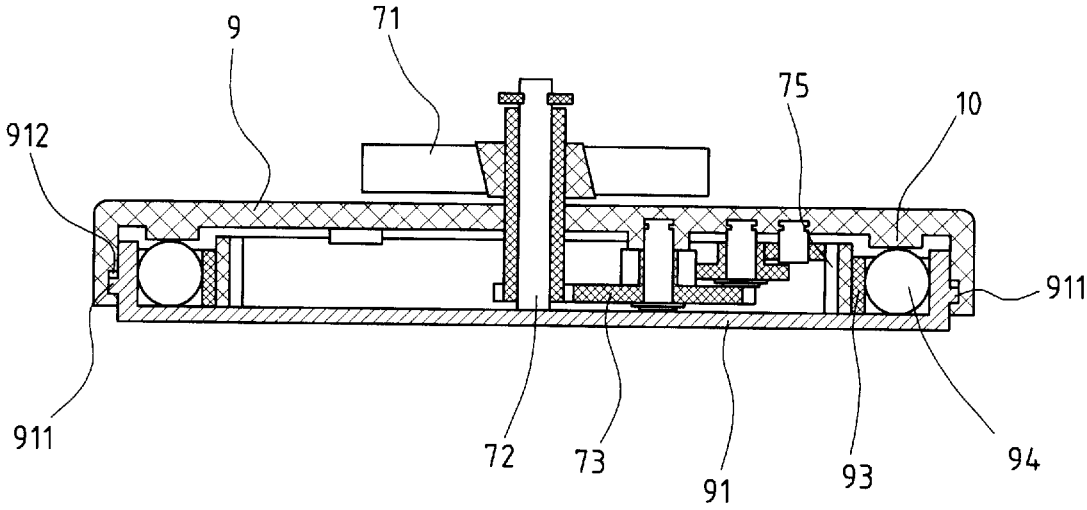
FIG. 3 is a partially cutaway sectional view of this invention.

As indicated in FIGS. 1 through 3, a decorative aqua ball of this invention mainly comprises a base 1, a power device 2, a music box 3, a transparent casing 4, an inside ornamental article 5, and a lid plug 6.

The power device 2 is disposed in a cavity of the base 1 and could be an electromechanical power source, a spring, or the like. A spring is adopted in an embodiment of this invention for serving as a power source.

The music box 3 is connected to and driven by the power device 2 for playing a piece of music. The transparent casing 4 residing on the base 1 is filled with water and brilliant colorful drift. The ornament article 5 in diversified shapes is arranged in the transparent casing 4, and an artificial mountain is adopted for this embodiment.

The lid plug 6 is attached to an opening portion of the transparent casing 4 for sealing the casing and for supporting the ornamental article 5. The lid plug 6 is capable of hermetically sealing the opening portion of the transparent casing 4 to avoid leakage. Moreover, the lid plug 6 is substantially a rubber panel having an annular flange 61 formed on its outer wall for matching with a recessed groove in the transparent casing 4. And, a snap ring is formed on an upper surface and a lower surface of the lid plug 6 respectively for mating with a bowl 81 and a steady table 91 to be described later.

The decorative aqua ball further comprises a rotation means composed of an upper turntable and a lower turntable 9, 8 synchronously and rotatably arranged on each top or bottom face of the lid plug 6 in virtue of mutual attraction of respective pieces of enhanced magnets 10 residing face to face on the turntables. In this case, there are two pieces of the magnets 10 provided to each turntable. Furthermore, the lower turntable 8 is connected to and driven by the power device 2 to rotate.

The tower turntable 8 is composed of a table body 82 and a rotation shaft 83, in which the magnets 10 reside on the top face of the table body 82, which penetrates a bowl 81 and is rotatably disposed on the bottom face of the lid plug 6. The rotation shaft 83, unified with the table body 82, has its bottom end penetrated through the bowl 81 to joint with an upwardly extended transmission shaft 21 of the power device 2.

To facilitate placement and rotation of the turntable 8, a protruding platform 811 is arranged centrally on the bowl 81 so that the table body 82 is rotatably supported on the platform 811. The bottom end of the shaft 83 extends downwardly over the base plate of the bowl 81. Between the table body 82 and the bowl 81, a sliding ring 84 and an annular snap fastener 85 are provided for positioning and fixing the turntable in place, wherein the sliding ring 84 is hitched and fixed on the shaft 83 through the snap fastener 85 and positioned between the bottom face of the bowl 81 and the snap fastener 85. Meanwhile, in order to reduce frictional resistance of the table body 82 for sustaining reliable rotation, the top face of the sliding ring 84 is an upwardly tapered inverted conic "V" face so that the contact area between the sliding ring 84 and the table body 82 is reduced accordingly.

The upper turntable 9 is rotatably supported on a top surface of the lid plug 6 through a bearing means, and the magnets are attached on a bottom face of the upper turntable 9. The ornamental article 5 is placed on a top face of the upper turntable 9 to go rotating after the turntable.

The bearing means comprises a steady table 91, a positioning ring 93, and a plurality of roller beads 94, in which the steady table 91 is fixed on the top surface of the lid plug 6 and the positioning ring 93 is set in the steady table 91; and an annular rolling channel is formed between an outer perimeter of the positioning ring 93 and an inner perimeter of the steady table 91 for accommodating the roller beads 94. Also, a plurality of semi-circular gaps is made available in the outer perimeter of the positioning ring 93 for setting the roller beads 94. The upper turntable 9 is disposed on the steady table 91 and rotatably supported on the roller beads 94 with its lateral wall hitched around the outside of the steady table 91, which is provided with at least one protruding rib 911. At least a corresponding mating annular groove 912 is formed in the inner wall of the upper turntable 9 for the reception of the protruding rib 911. In this case, four roller beads 94 are uniformly spaced around the positioning ring 93.

In order to enhance the beauty of the aqua ball of this invention and ensure a water-rowing operation on the basis of consuming less power, the upper turntable 9 is equipped with a water-rowing device, which includes a rowing oar-blade set 71, a positioning shaft 72, a transmission gear set 73, and a ferrule 75 with internal teeth. The positioning shaft 72 is centrally fixed at the steady table 91 with its top end extended over the top surface of the upper turntable 9. The oar-blade set 71 is situated above the top surface of the upper turntable 9, and for the sake of keeping the oar-blade set 71 in rowing water flow continuously, the bottom end of the ornamental article 5 is provided with a through hole for the reception of the oar-blade set 71. Moreover, the oar-blade set 71 is communicable with the liquid filled in the transparent casing 4 and connected to the upper segment of a rear stage gear of the transmission gear set 73 and fixed to the positioning shaft 72 through a snap ring. The lower segment of the rear stage gear of the transmission gear set 73 is sleeve-jointed with the positioning shaft 72. Both a front stage and a middle stage gear are installed on the bottom surface of the upper turntable 9, in which the front stage gear is engaged with the internal teeth of the ferrule 75, which is fixed at a middle portion or the steady table 91.

In short, the decorative aqua ball of this invention is started by the spring, then the music box plays a piece of music, the transmission shaft jointed to the spring drives the lower turntable to rotate, the upper turntable and the lower turntable rotate synchronously in virtue of the enhanced magnets, and the inside ornamental article of the transparent casing is driven to rotate accordingly to present a dynamic scene. In addition, the water flow in the transparent casing is driven to recycle repetitively by taking advantage of the water-rowing device, the transmission gear set, and the oar-blade set to thereby show a pleasant scene of drifting phenomenon.

Figure 4:
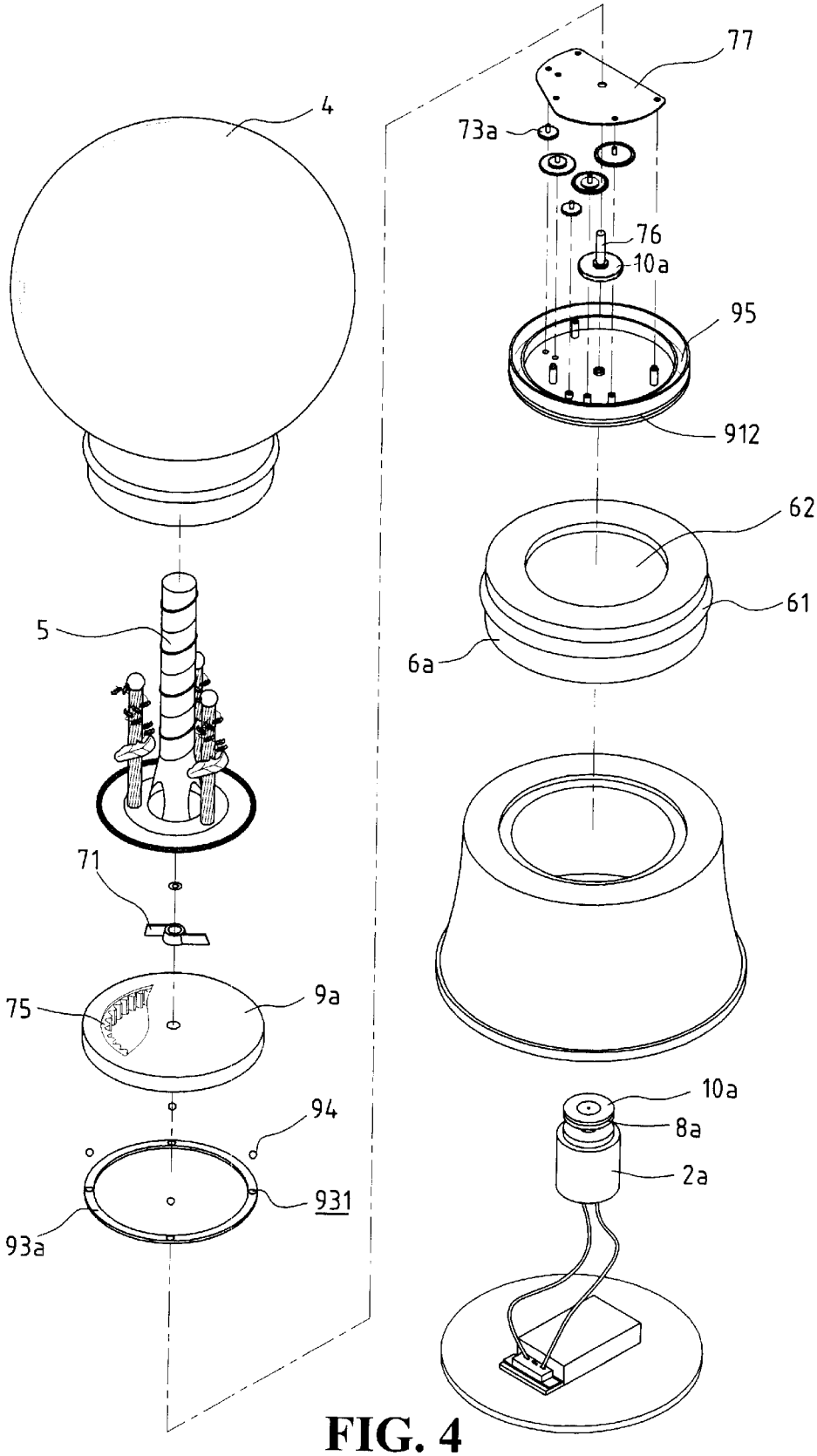
FIG. 4 is an exploded view of another embodiment of this invention.
Figure 5:
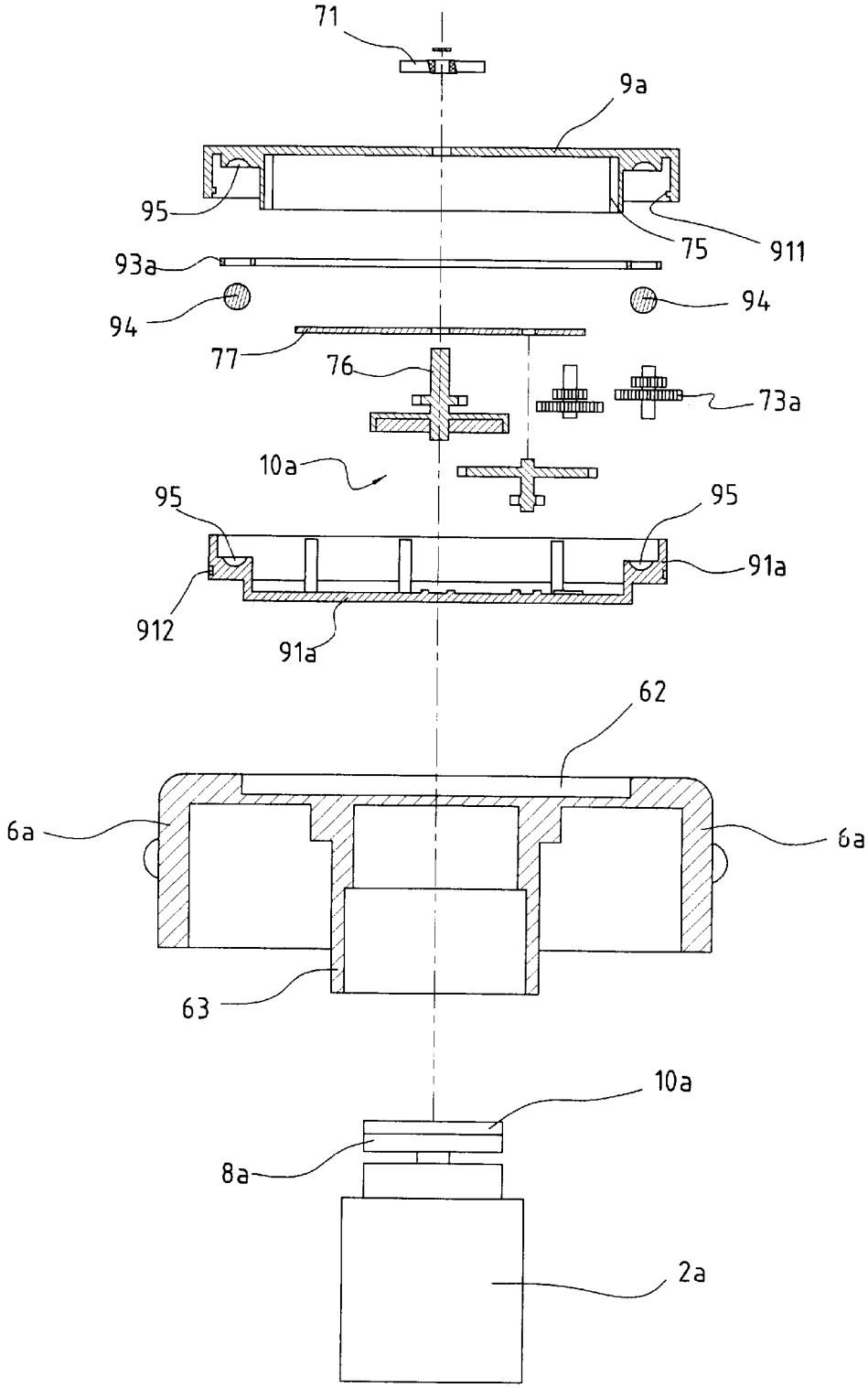
FIG. 5 indicates exploded cutaway section of some parts in another embodiment of this invention.

In another embodiment (shown in FIGS. 4, 5 and 6), some parts are revised and described below with the exception of the base 1, the inside ornamental article 5, and the transparent casing 4.

The power device 2 is substituted by another power device 2*a* (an electric power motor). A lower turntable 8*a* is engaged directly with a power output shaft of the power device 2*a,* in which a large disk-type powerful magnet 10*a* is disposed on the lower turntable 8*a*. A battery case is added to a music box 3*a* that uses battery and electric circuit to generate electronic music.

The lid plug 6 (6*a* in this embodiment) doesn't change much in structure. For example, the annular flange 61 is formed on its outer wall for matching with a recessed groove for closing the opening of the transparent casing 4 and hermetically sealing the casing. Nevertheless, it changes in that a recessed groove 62 is formed in a top surface of the lid plug 6*a* for mating with the bottom end of a steady table 91*a,* while its inside bottom surface is provided with a choke ring 63 having an inside ladder for snap-retaining the power device 2*a*.

Figure 6:
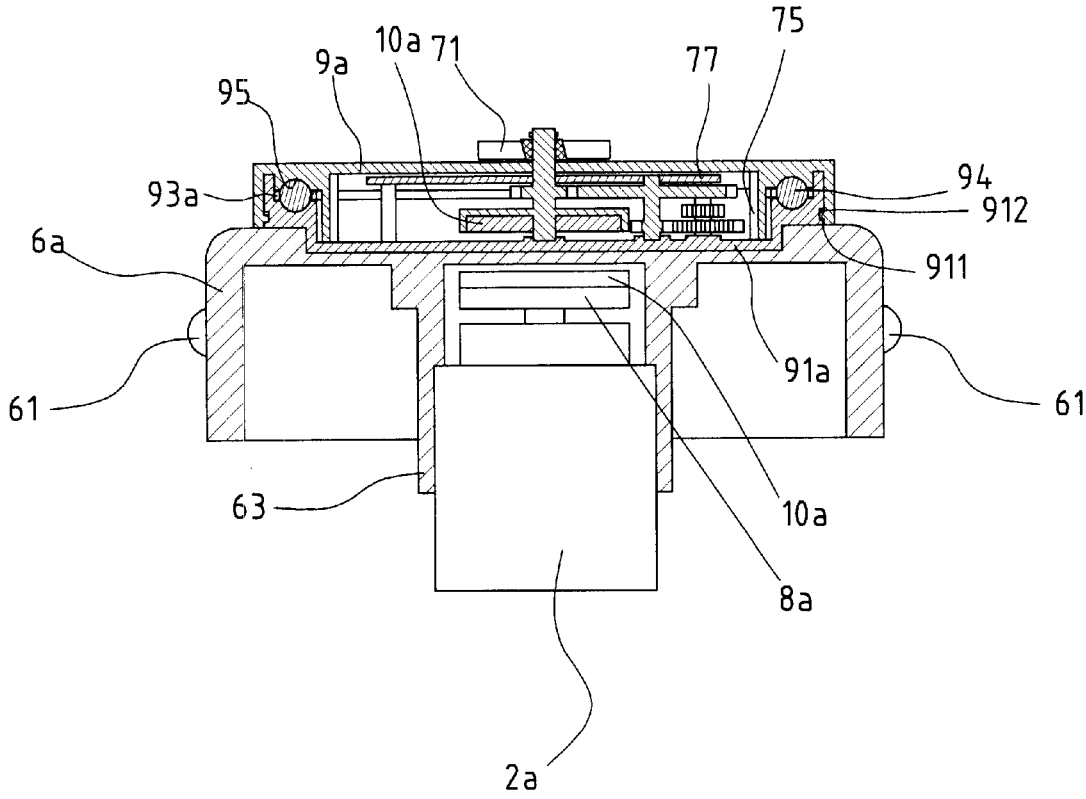
FIG. 6 indicates assembled cutaway section of some parts in another embodiment of this invention.

The upper turntable 9 and the steady table 91 (herein 9*a* and 91*a*) are clenched together, in which the former is rotatable while the latter is fixed on the lid plug 6*a,* and a plurality of roller beads 94 as well as a positioning ring 93*a* is aligned or set in-between the tables. A loop-rolling lane 95 is arranged on the bottom face of the upper turntable 9*a* and on the top face of the steady table 91*a* for rolling the roller beads 94, in which the cutaway section of the loop-rolling lane 95 is a semi-circular arc. A through hole 931 is perforated in the positioning ring 93*a* with an inner diameter longer than the diameter of the roller bead 94. When assembling, the positioning ring 93*a* is just located in the loop-rolling lane 95 between the upper turntable 9*a* and the steady table 91*a* (as shown in FIG. 6), and the roller beads 94 is disposed in the through hole 931.

In this embodiment, since no powerfull magnet is offered to the upper turntable 9*a,* hence, the turntable is not a component driven directly by the power device 2*a*. The upper turntable 9*a* has at least an annular protruding rib 911 in its inner wall and at least a corresponding mating annular groove 912 is formed in the outer wall of the steady table 91*a* for the reception of the protruding rib 911, in which the protruding rib 911 and the annular groove 912 are buckled in a loose-combination manner, i.e., both parties cannot depart from each other after being buckled, nevertheless, the upper turntable 9*a* is still rotatable.

The water-rowing action in this embodiment is modified on a large scale. The water-rowing device comprises the oar-blade set 71, a rotation shaft 76, the transmission gear set 73*a,* the ferrule 75 with internal teeth, and a fixing piece 77. The rotation shaft 76 having a gear on the upper side and a magnet 10*a* on the bottom side is located at a position corresponding to said magnet 10*a* of the lower turntable 8*a* such that it can rotate freely and synchronously. The top end of the rotation shaft 76 penetrates through the upper turntable 9*a* and the oar-blade set 71 sits thereon. The transmission gear set 73*a* is integrally molded and held in the steady table 91*a* by the fixing piece 77. Moreover, the last stage gear wheel of the transmission gear set 73*a* is engaged with the gear teeth of the rotation shaft 76 while its front stage gear wheel is engaged with the internal teeth of the ferrule 75, which is fixed at a middle portion of the turntable 9*a* to permit the turntable to rotate when the rotation shaft is driven to rotate via the linked gear wheels.

In summary, this embodiment is operated in the manner of: producing electronic music from the music box; providing power to start the power device and drive the lower turntable to rotate synchronously; driving the lower turntable and the rotation shaft to rotate synchronously by taking advantage of the powerful magnets in-between and meanwhile make the oar-blade set directly combined with the rotation shaft rotate to thereby accelerate the cyclic water flow in the transparent casing and distinctly show the movement of the drift inside the casing; and driving the upper turntable to move the rockery-like inside ornamental article slowly and present a dynamic sightly scene.

At least one preferred embodiment has been described in the above described in detail with reference to the drawings annexed, and it is apparent that numerous variations or modifications may be made without departing from the true spirit and scope thereof, as set forth in the claims below.

What is claimed is:

1. A decorative aqua ball, comprising:

a base;

a power device disposed in the base for providing power;

a music box connected to and driven by the power device for playing music;

a transparent casing residing on the base;

an ornamental article arranged in the transparent casing;

a lid plug attached to an opening portion of the transparent casing for hermetically sealing the transparent casing;

an upper turntable disposed on a top face of the lid plug for supporting the ornamental article;

a bowl coupled with the lid plug; and a lower turntable having a table body disposed on a bottom face of the lid plug above the bowl, and a rotation shaft extending downwards through a central hole of the bowl and connecting to a transmission shaft of the power device;

wherein at least a magnet is disposed on the upper turntable and at least a magnet is disposed on the lower turntable.

2. The decorative aqua ball according to claim 1, wherein the table body of the lower turntable is rotatably supported on the bowl, a sliding ring and a snap fastener are provided for positioning and fixing the lower turntable in place, and the sliding ring is hitched and fixed on the rotation shaft of the lower turntable by means of the snap fastener and positioned between a bottom face of the bowl and the snap fastener.

3. A decorative aqua ball, comprising:

a base;

a power device disposed in the base for providing power;

a music box connected to and driven by the power device for playing music;

a transparent casing residing on the base;

an ornamental article arranged in the transparent casing;

a lid plug attached to an opening portion of the transparent casing for hermetically sealing the transparent casing and;

a steady table fixed on a top surface the lid plug;

a positioning ring set in the steady table;

an annular rolling channel formed between an outer perimeter of the positioning ring and an inner perimeter of the steady table;

a plurality of roller beads accommodated within the annular rolling channel and set on a plurality of semicircular gaps formed on the outer perimeter of the positioning ring;

an upper turntable disposed on the steady table for supporting the ornamental article, the upper turntable having at least a magnet attached on a bottom surface of the upper turntable;

a lower turntable disposed on a bottom face of the lid plug, the lower turntable having at least a magnet placed on a top surface of the lower turntable;

wherein the upper turntable is rotatably supported on the roller beads with an outer wall of the upper table hitched onto an outer wall of the steady table.

4. The decorative aqua ball according to claim 3, wherein the steady table is provided with at least an annular protruding rib and at least a corresponding annular groove is formed on an inner wall of the upper turntable for receiving the protruding rib.

5. The decorative aqua ball according to claim 3, wherein a bowl is coupled with the lid plug, the lower turntable has a table body disposed on a bottom face of the lid plug above the bowl and a rotation shaft extending downwards through a central hole of the bowl and connecting to a transmission shaft of the power device.

6. The decorative aqua ball according to claim 3, wherein four roller beads are uniformly distributed around the positioning ring.

7. The decorative aqua ball according to claim 3, the upper turntable having a water rowing device comprising:

a positioning shaft being centrally fixed at the steady table and having a top end extended over a top surface of the upper turntable;

a rowing oar-blade set situated above the top surface of the upper turntable and fixed to the positioning shaft;

a ferrule with internal teeth; and a transmission gear set including a front stage gear, a middle stage gear, and a rear stage gear having an upper segment connected to the rowing oar-blade set and a lower segment sleeve-jointed with the positioning shaft;

wherein the front stage gear and the middle stage gear are installed on a bottom surface of the upper turntable, the front stage gear is engaged with the internal teeth of the ferrule which is fixed at a middle portion of the steady table, an upper segment of the rear stage gear is connected to the rowing oar-blade set, and a lower segment of the rear stage gear is sleeve-jointed with the positioning shaft.

8. The decorative aqua ball according to claim 3, wherein the lid plug is substantially a rubber panel having an annular flange formed on an outer wall for matching with a recessed groove in the transparent casing.

9. A decorative aqua ball, comprising:

a base;

a power device disposed in the base;

a lower turntable jointed with an output shaft of the power device, the lower turntable having at least a magnet placed on a top end;

a music box connected to and driven by the power device for playing music;

a transparent casing residing on the base;

an ornamental article arranged in the transparent casing;

a lid plug attached to an opening portion of the transparent casing for hermetically scaling the transparent casing and formed with a choke ring in an inner lower face to retain the power device;

a box disposed on an upper face of the lid plug and comprising a steady table and an upper turntable for supporting the ornamental article;

a rowing oar-blade set; and a rotation shaft fitted in the steady table and extended through the upper turntable to connect to the rowing oar-blade set;

wherein the rotation shaft is rotatable in the steady table and at least a magnet is arranged on a bottom end of the rotation shaft at a position corresponding to a magnet on the lower turntable.

10. The decorative aqua ball according to claim 9, wherein the upper turntable is rotatable while the steady table is fixed on the lid plug; at least two roller beads and a positioning ring are placed in between the upper turntable and the steady table; two respective loop-rolling lanes each having a semi-circular cross section are formed on a bottom face of the upper turntable and a top face of the steady table respectively for rolling the roller beads; and at least two through holes are perforated in the positioning ring to accommodate the roller beads.

11. The decorative aqua ball according to claim 9, wherein a recessed groove is formed on a top surface of the lid plug for mating with a bottom end of the steady table and an inside bottom surface of the lid plug is provided with a choke ring having an inside ladder for snap-retaining the power device.

12. The decorative aqua ball according to claim 9, wherein a water-rowing device is disposed in the upper turntable and the steady table, the water-rowing device comprising:

a rotation shaft having gear teeth;

a ferrule formed with internal teeth;

a transmission gear set including a front stage gear engaged with the internal teeth of the ferrule and a rear stage gear engaged with the gear teeth of the rotation shaft; and a fixing piece holding and supporting the transmission gear set and the rotation shaft.

13. The decorative aqua ball according to claim 9, wherein the upper turntable has at least an annular protruding rib formed on an inner wall and at least a corresponding mating annular groove is formed on an outer wall of the steady table for buckling the annular protruding rib in a loose-combination manner.

* * * * *